US011484918B2

(12) United States Patent
Thorstensson et al.

(10) Patent No.: US 11,484,918 B2
(45) Date of Patent: Nov. 1, 2022

(54) BARREL CLEANER

(71) Applicant: CLEAN MACHINE AUST, Kilburn (AU)

(72) Inventors: Ulf Thorstensson, Kilburn (AU); Kyle Hocking, Kilburn (AU)

(73) Assignee: CLEAN MACHINE AUST, Kilburn (AU)

( * ) Notice: Subject to any disclaimer, the term of this patent is extended or adjusted under 35 U.S.C. 154(b) by 623 days.

(21) Appl. No.: 16/489,349

(22) PCT Filed: Jan. 31, 2018

(86) PCT No.: PCT/AU2018/050056
§ 371 (c)(1),
(2) Date: Aug. 27, 2019

(87) PCT Pub. No.: WO2018/141008
PCT Pub. Date: Aug. 9, 2018

(65) Prior Publication Data

US 2020/0070221 A1 Mar. 5, 2020

(30) Foreign Application Priority Data

Feb. 1, 2017 (AU) ..... 2017900299
Feb. 7, 2017 (AU) ..... 2017200831

(51) Int. Cl.
*B05B 9/00* (2006.01)
*B05B 13/06* (2006.01)
*B05B 15/68* (2018.01)
*B08B 9/08* (2006.01)

(52) U.S. Cl.
CPC ..... *B08B 9/0813* (2013.01); *B05B 9/007* (2013.01); *B05B 13/0627* (2013.01); *B05B 15/68* (2018.02); *B08B 9/0821* (2013.01)

(58) Field of Classification Search
None
See application file for complete search history.

(56) References Cited

U.S. PATENT DOCUMENTS 3,082,776 A 3/1963 Stauffer
6,557,566 B1 5/2003 Rudolfs
2015/0209842 A1 7/2015 Buhl

OTHER PUBLICATIONS

International Search Report dated Apr. 24, 2018, in International Application No. PCT/AU2018/050056. (4 pages).
Written Opinion of the International Searching Authority dated Apr. 24, 2018, in International Application No. PCT/AU2018/050056. (4 pages).

*Primary Examiner* — Levon J Shahinian
(74) *Attorney, Agent, or Firm* — Shutts & Bowen LLP

(57) ABSTRACT

Disclosed is a barrel cleaner (10), including a cantilevered lift to raise a barrel, bearings (31, 32) to permit rotation of the barrel once raised, and a spray head support (20) including a spray head. In use the barrel may be rotated so that a bung hole of the barrel is in an insertion position, and the support can be operated to insert the spray head into the bung hole.

8 Claims, 5 Drawing Sheets

BARREL CLEANER

CROSS-REFERENCE TO RELATED APPLICATIONS

This application is a § 371 national phase entry of International Application No. PCT/AU2018/050056, filed Jan. 31, 2018, which claims priority to Australian Patent Application No. 2017200831, filed Feb. 7, 2017 and Australian Patent Application No. 2017900299, filed Feb. 1, 2017, the entirety of which is incorporated herein by reference.

TECHNICAL FIELD

The present invention relates to apparatus for cleaning barrels, particularly wine barrels.

BACKGROUND OF THE INVENTION

Wooden barrels, typically made from oak staves, are widely used in the aging of products such as wine, spirits and some food products. These barrels are formed in various sizes, however when used for wine they are generally in the range of 200 l to 600 l, commonly 225-300 l.

In wine production, the barrels are used to allow for the aging of the contents, as well as to allow for tannins and other oak characteristics to be imparted to the wine. The barrels are typically formed from staves and sealed with 6-8 steel hoops, with a bung hole formed in the bilge, the widest part of the barrel.

The relatively small bung hole and relatively large internal space of the barrel creates a difficulty for cleaning. It is clearly not possible to manually clean most of the interior surfaces. A common modern practice is to use a high pressure spray head system, inserted through the bung hole from below. This is an effective cleaning technique.

However, in order to operate such a system, the barrel must first be moved from the storage position, generally with the bung on the upper surface, into a position with the bung almost at the bottom of the barrel. The spray head can then be inserted on its stem, and the barrel again adjusted so that the bung is at the lowest point. The spray head is then operated for the required period, and the procedure reversed.

This procedure creates a lot of manual work in rotating the barrels, which typically weigh 40-60 Kg, with consequent risks for the health and safety of workers. Further, the procedure allows for the spray head unit to be operated before it is inserted into a barrel. As the head typically operates with jets a pressure of about 1500-2500 psi, this is a significant safety issue for the operator and their co-workers.

It is an object of the present invention to provide a wine barrel cleaner which improves the safety of the operator conducting a cleaning operation.

SUMMARY OF THE INVENTION

In a first broad form, the present invention provides a barrel cleaner, including a mechanism for allowing rotation of the barrel, and a spray head mounted on a support, the support being moveable on the apparatus, so that the barrel can be rotated and the spray head brought into an operable position inside the barrel.

According to one aspect, the present invention provides a barrel cleaner, including a body, the body including a manually operable cantilevered lift to raise a barrel, bearings to permit rotation of the barrel once raised, and a spray head support including a spray head, wherein operatively the barrel may be rotated so that a bung hole of the barrel is in an insertion position, and the spray head support can be moved to insert the spray head into the bung hole.

Suitable implementations of the invention according allow for a barrel to lifted, rotated, and cleaned using a simple manual operation, without requiring the weight of the barrel to be lifted by the operator. Moreover, this can be achieved by a single operator.

In some implementations, the cleaner further includes an interlock to prevent operation until the spray head support is moved to an operative position, so that the spray head is not operated in an unsafe manner. Other aspects of the present invention will be apparent from the description below.

BRIEF DESCRIPTION OF THE DRAWINGS

An illustrative implementation the present invention will now be described with reference to the accompanying figures, in which.

DETAILED DESCRIPTION OF THE INVENTION

An implementation of the present invention will now be described in detail. It will be understood that the implementation described is only one possible implementation, and the description is intended to be illustrative of the invention, and not limitative of its scope.

The present invention will be described with reference to an implementation for typical wooden barrels used in the wine industry. However, the present invention is equally applicable to larger or smaller barrels, formed from wood, metal or other materials. The present invention may also be applied in any suitable industry, and is not confined only to use with wine barrels.

The present invention will be described in the context of a typical cleaning process for wine barrels in a winery. The barrels are typically mounted on their sides on racks, which stack for long term storage. After the contents are removed, e.g. for bottling or blending, the barrel is cleaned before re-use.

To achieve this, in a conventional system, the barrel is manually rotated, so that the bung hole is at a point near the lowest point of the barrel. The spray head, which is typically mounted on wheels, is moved into position so the head is slightly inserted into the barrel. The barrel is then further rotated, so that the bung hole is at the lowest point of the barrel, and the spray head moves with it. The spray head is connected to a suitable pump to drive water into the barrel, operated for the required period of typically 1-5 minutes, and turned off. After a period for drainage, the barrel is again manually rotated, to a position where the spray head can be removed. The barrel is further manually rotated so that the bung hole is at the top.

The implementation of the present invention which will now be described achieve this same process, but using a single apparatus.

Figure 1:
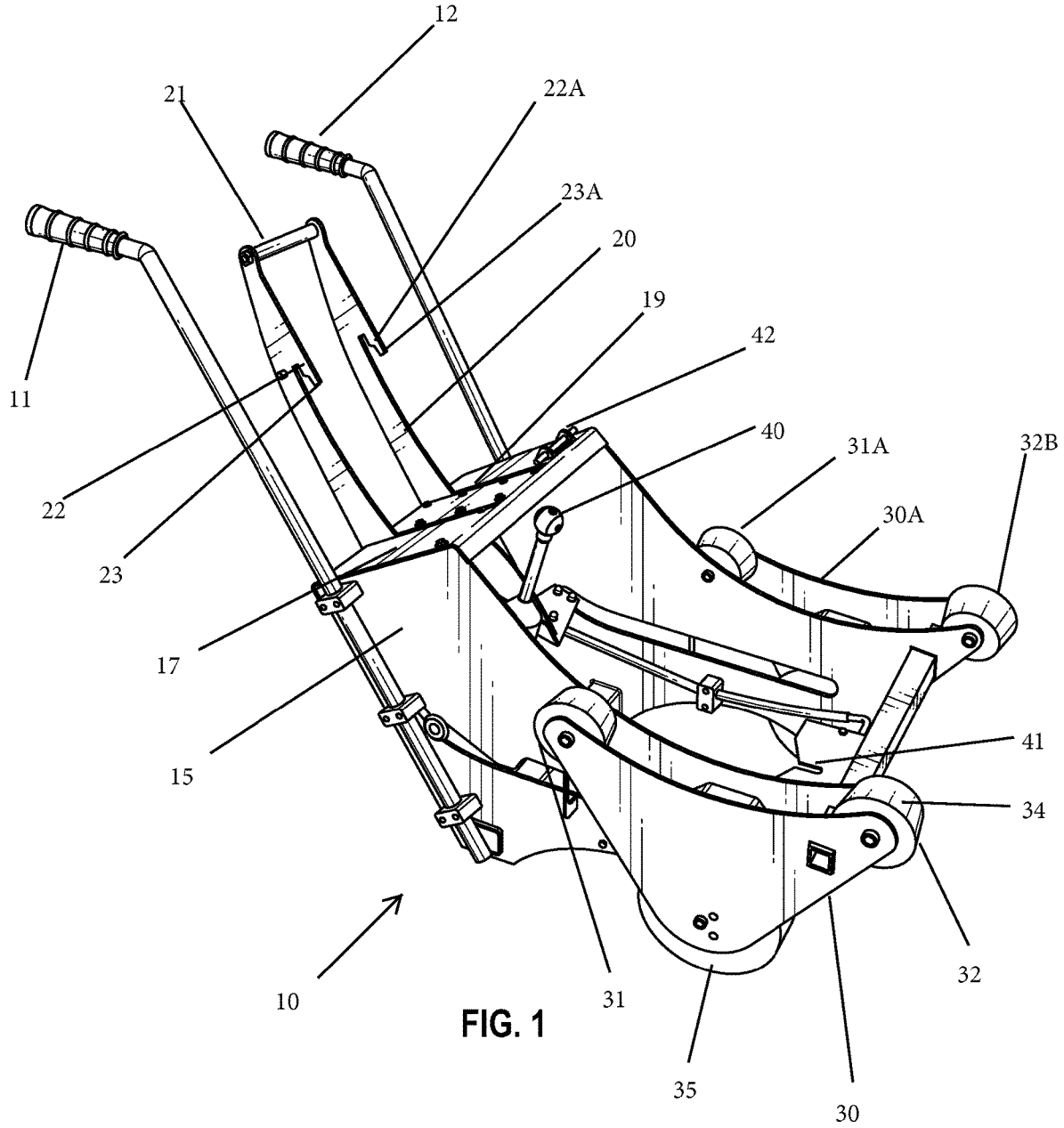
FIG. 1 is an isometric view showing a first implementation in a starting position.

Referring to FIG. 1, this shows an apparatus 10, having handles 11, 12 and wheel sections 30,30A. Each wheel section 30, 30A has a wheel 35 for ground engagement, and rollers 31, 31A, 32, 32B for engaging a barrel. Rollers 31, 31A, 32, 32B each have an angled surface 34.

Apparatus 10 also has a body 15, with an upper surface, having slots 18, 19. Spray head support 20 is mounted so as to slide in use in slots 18, 19. Slide 20 is operated by movement of handle 21, as will be explained further below. Slide 20 includes at the lower end spray head 40. Slide 20 also includes notches 22, 22A and stepped lug 23, 23A. It can be seen that in the position of FIG. 1, spray head 40 is contained within body 15 and so protected against casual contact with its surroundings as the apparatus is moved around and engaged with a barrel.

Figure 2:
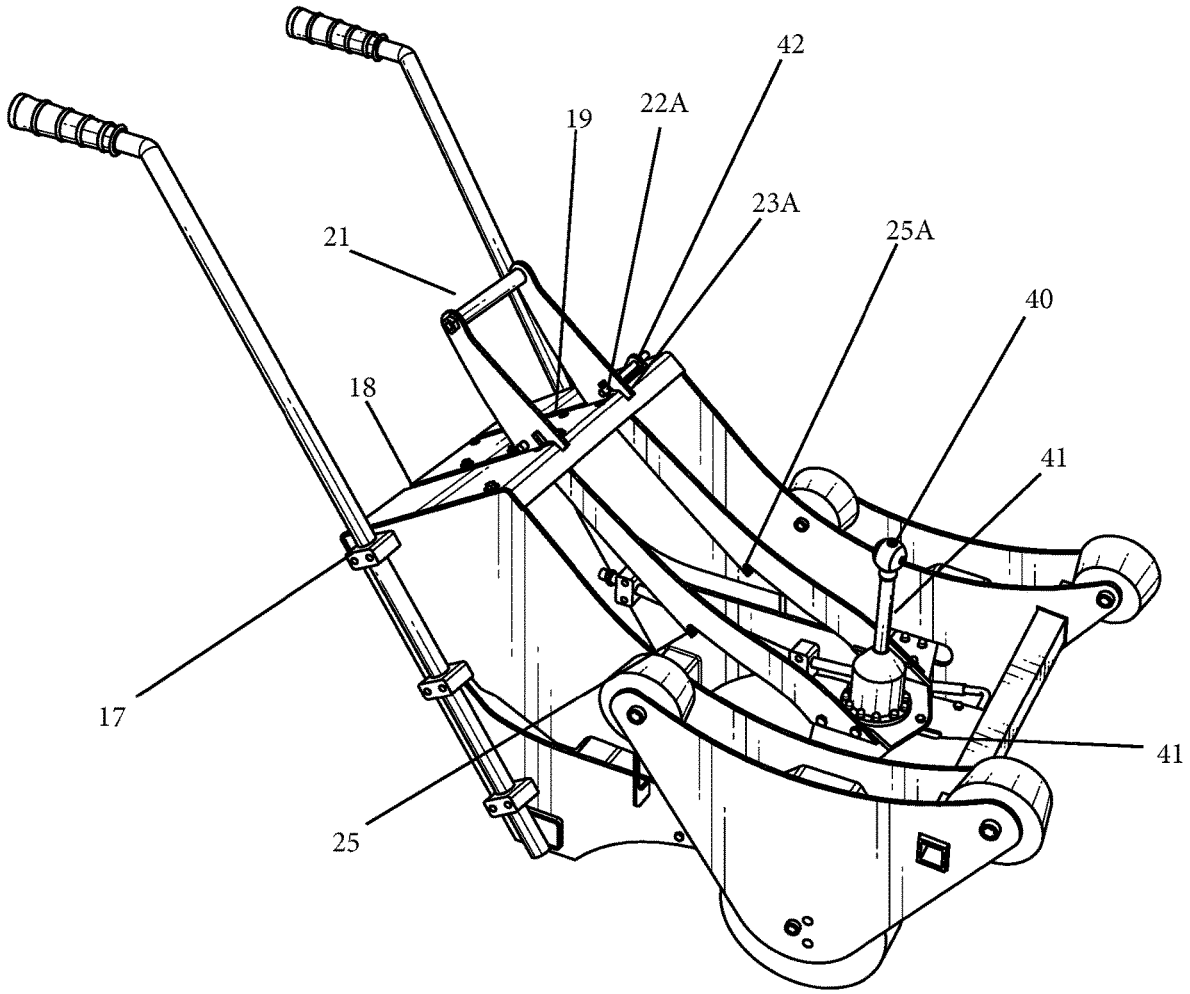
FIG. 2 is a similar view to FIG. 1, showing the implementation in a second partly engaged position.

FIG. 1 represents the apparatus 10 in a rest position. FIG. 2 shows the apparatus 10 in a partly engaged position, when the support 20 has been moved into the bung hole 71 and just prior to operation, as will be described further below. In this position, support 20 has been moved by sliding into a position supported by lugs 23, 23A. Lugs 23, 23A have a stepped profile, and in this position the first step is engaged. Latch 42 prevents the support 20 moving further, by projecting through and engaging slot 22A.

In this position, it can be seen that the spray head 40 has moved some distance, in particular along slot 41. Under slot 41 (not visible) is a mechanical engagement, which must be actuated in order for water to flow through spray head 40. Thus, safety-latch 42 provides a protective interlock, so that until it is released, water cannot flow, and hence the spray head 40 cannot be readily activated unless safety-latch 42 has been dis-engaged. The mechanical engagement could alternatively be electrical, a sensor, or any other suitable arrangement. Similarly, in other implementations the controlled switch could be elsewhere on the apparatus, with a different form of release mechanism. For example, a switch or sensor could be engaged elsewhere on the support frame or body, with the release being controlled by a button or switch on the handle, either electrically or using a mechanical cable control.

The position of FIG. 2 is also used for drainage after the washing is completed.

Figure 3:
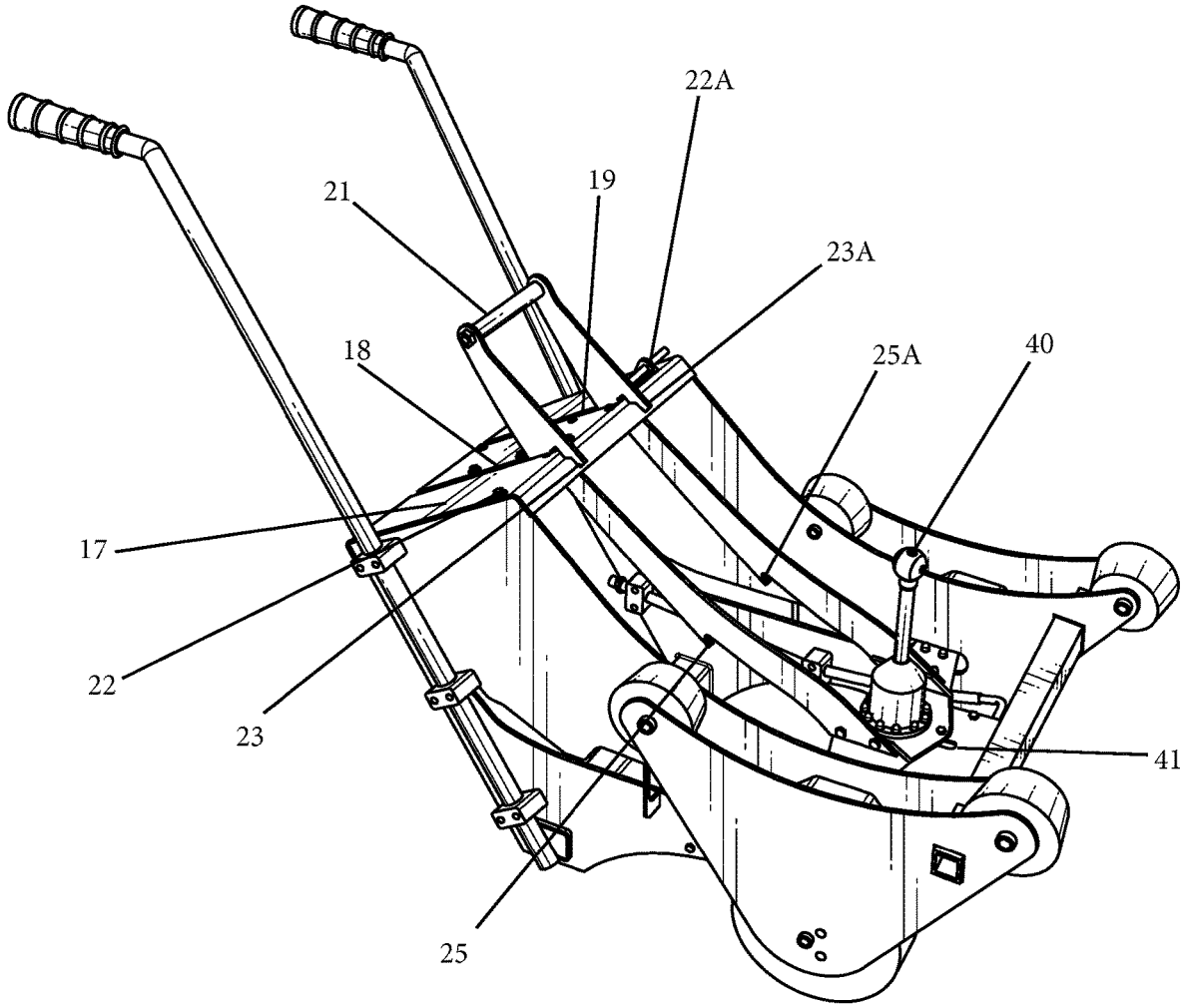
FIG. 3 is a similar view to FIG. 1, showing this implementation in a third, operative position.

FIG. 3 shows the situation where the safety latch has been released, so that the support now rests on the second step of lugs 23, 23A, and hence the support 20 has moved further. Spray head 40 has also moved corresponding, and the support 20 has moved further along slot 41, so that a downwards projection (not shown) has engaged the mechanical engagement for controlling water flow. Hence, spray operation is commenced in this position.

Spray head 40, in use, is connected to a suitable pump or other source of pressurised water, as is conventional for such cleaners and with which those skilled in the art will be familiar. Flow rates, pressures, etc. will be as specified by the supplier of the spray head.

The apparatus may be formed from any suitable materials. It is preferred that the device is mainly formed from stainless steel, preferably 316 stainless steel. The wheels and rollers may be formed from any suitable material, for example rubber or a polymer. The rollers are preferably formed from urethane, specified to be sufficiently hard and UV and chemical resistant.

The rollers shown in this implementation are tapered, in order to minimise the contacting surface area to ensure that they roll freely. Further, the taper allows for the barrel to be rolled so as to self-centre on the rollers, so that the lateral position of the spray head will be correct.

The spray head may be of any conventional type, for example an off the shelf barrel/Tank cleaner head from suppliers such as PA, Moog, Bolondi and other manufacturers. These heads will operate using a variety of high pressure pumps. Alternatively more basic rinse heads can be used that utilize mains water pressure.

Figure 4:
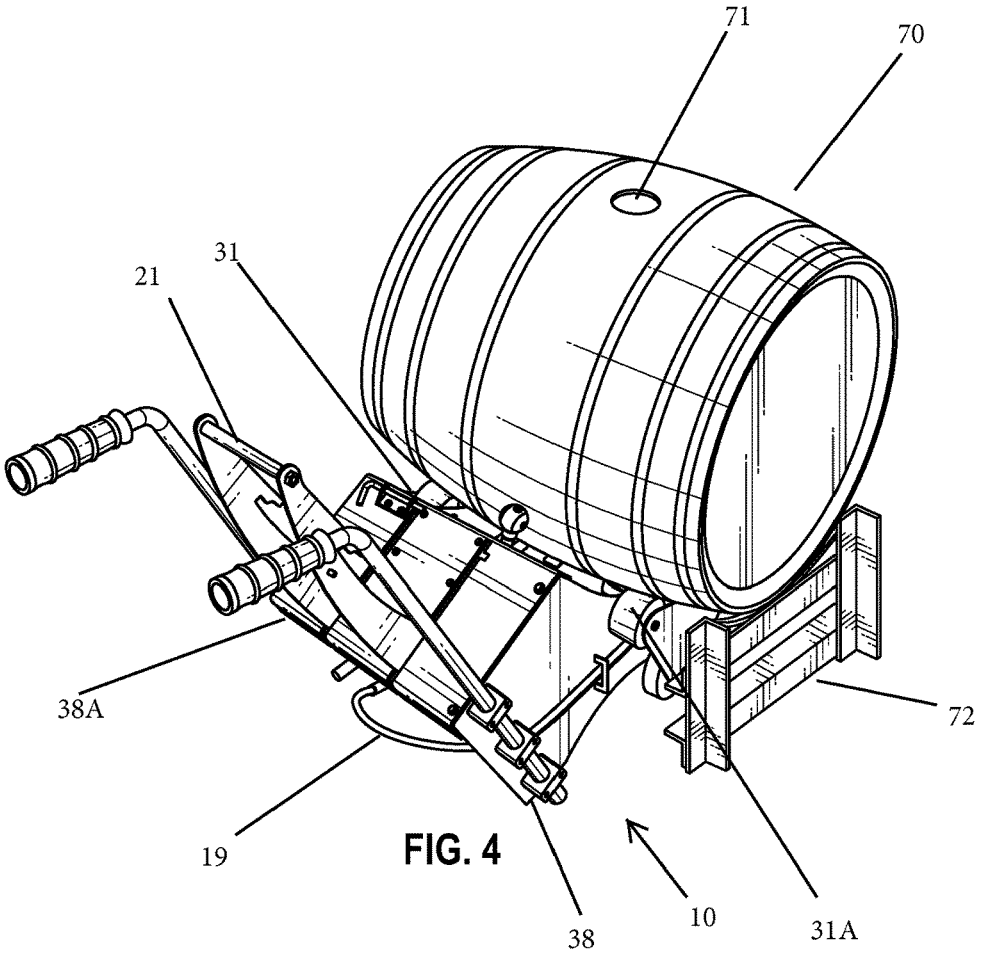
FIG. 4 shows a implementation engaging with a barrel, before rotation of the barrel.
Figure 5:
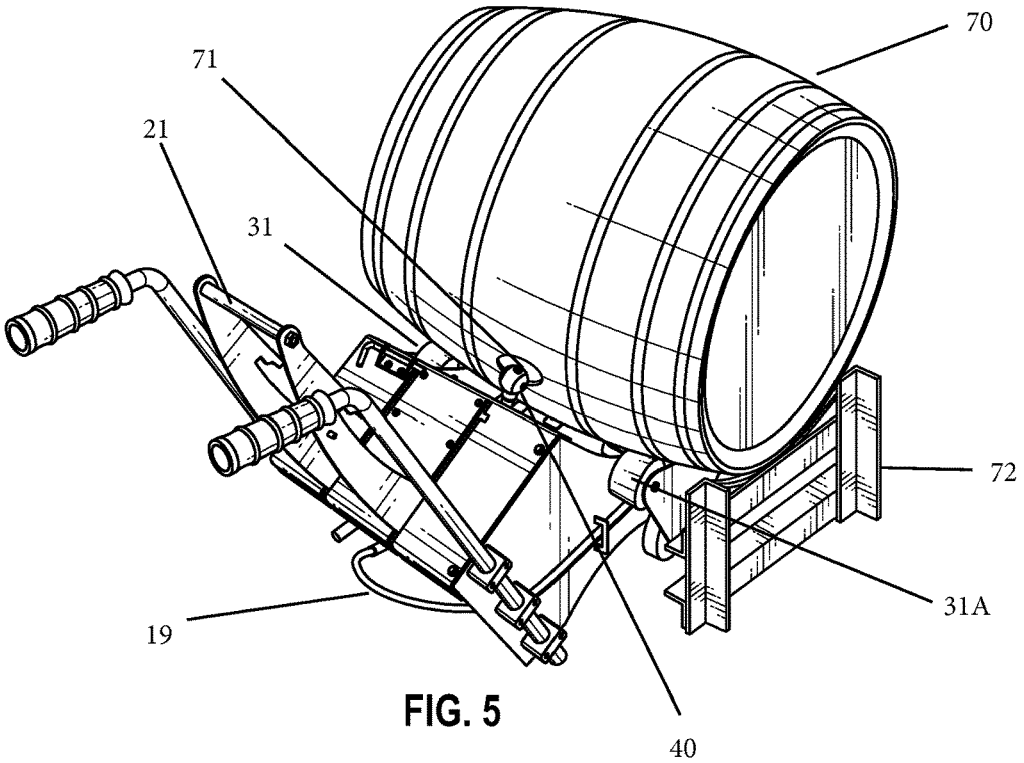
FIG. 5 shows the implementation of FIG. 4, with the barrel rotated and the spray head ready to insert.
Figure 6:
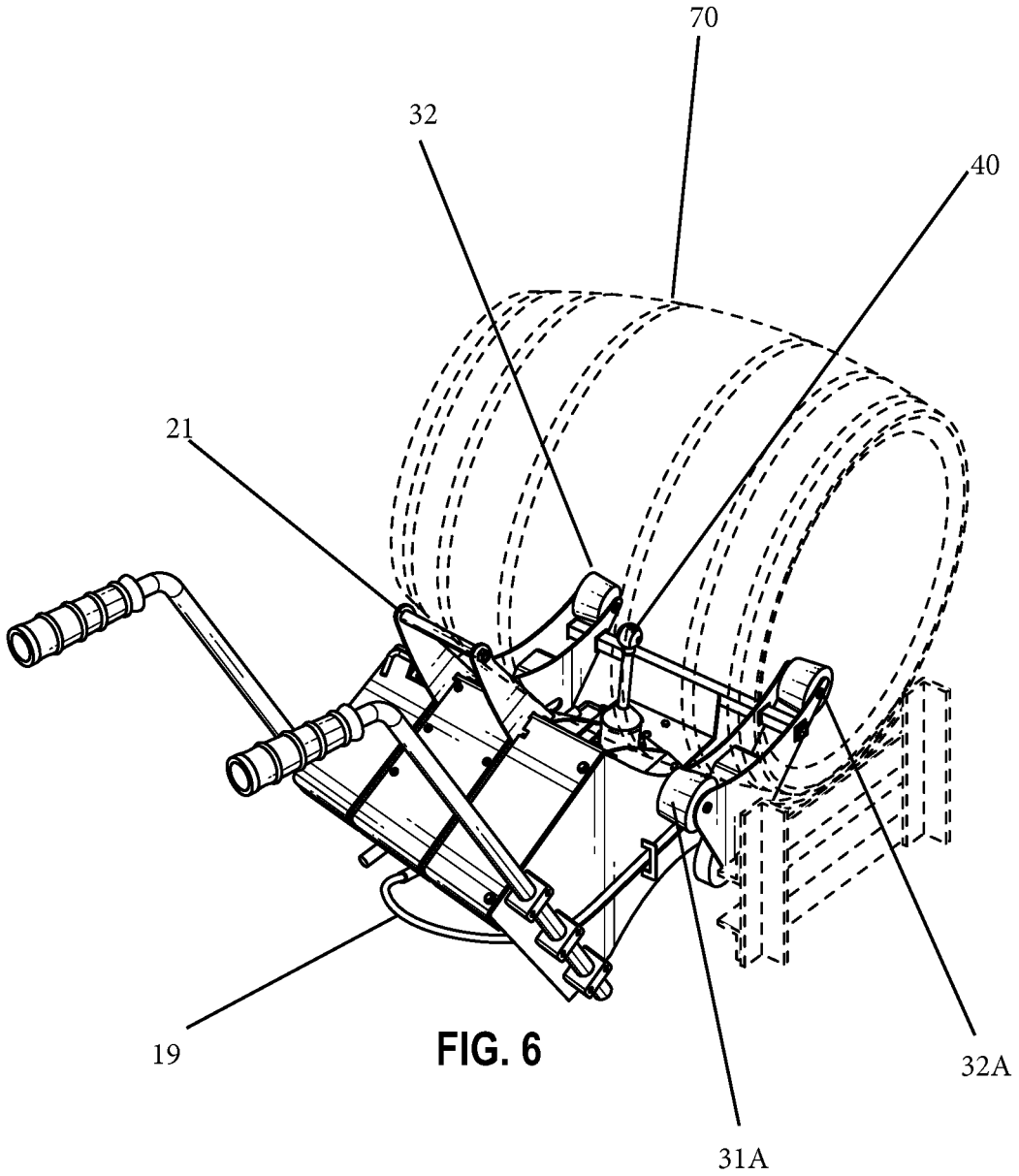
FIG. 6 shows the implementation of FIG. 4, with the barrel in dotted outline, and the spray head inside the barrel.

FIGS. 4 to 6 illustrate the use of the apparatus 10 with a barrel 70. Barrel 70 as illustrated in FIG. 4 is of conventional type, with a bung hole 71 at the top, resting initially on rack 72. Prior to the position of FIG. 4, apparatus 10 has been tilted forward, so that front rollers 32, 32A will easily be inserted under the barrel 70. Rollers 32, 32A have then been inserted under barrel 70, and the apparatus 10 tilted back on wheels 35, so as to cantilever barrel 70 slightly off rack 72. Apparatus 10 then rests on feet 38, 38A and wheels 35. Barrel 70 is therefore lifted from the rack, and resting on rollers 31, 31A, 32, 32B. Barrel 70 can then be rotated back and forward on the rollers with minimal effort by the operator.

It is also a feature of this implementation that the apparatus 10 can be tilted upright to the point where front rollers 32, 32A engage the ground thus allowing for manoeuvring in very tight spaces.

It can be seen that he support 20 is in the initial position shown in FIG. 1, fully withdrawn. The hose connections 19 for the spray head can also be seen in this view.

If bung hole 71 is not centred relative to spray head 40, rotation back and forward, with the action of angled surfaces 34 on the rollers, will centre the barrel.

In FIG. 5, barrel 70 has been rotated so that the bung hole is in the position just prior to insertion. Handle 21 has not been moved at this stage. From here, handle 21 is slid down, so that spray head 40 enters bung hole 71, while barrel 70 is rotated to the position where bung hole 71 is at the bottom of barrel 70.

Latch 40 can then be released, so that support 20 moves into the fully down position and spray head 40 performs the cleaning operation. FIG. 6 illustrates this state, with barrel 70 shown as transparent and the spray head 40 inside.

After completion, handle 21 is then moved so that the support is in the latched but engaged position, as in FIG. 2. This is the position where the water is allowed to drain for the required period. The handle 21 is then moved up, and the barrel 70 rotated, so that the spray head 40 is removed. Barrel 70 may then be returned to the position with bung hole 71 at the top. Apparatus 10 can then lower barrel 70 and be removed.

It can be seen that this arrangement removes the need for barrels to be lifted or rotated against their own weight on the rack, while also allowing for the spray head to be inserted as part of the same operation. Further, the interlock minimised the risk of unsafe spray head operation. This improves safety and convenience for the operator.

It will be appreciated that the present invention may be implemented with many alternative mechanic components in order to achieve a working implementation, and that the present invention is not limited to the specific implementations described. For example, alternative bearings could be used to allow the barrel to rotate, and additional rollers or balls could be provided. The support shown could be different in shape or construction, as will be apparent to those skilled in the art. While the support is shown as sliding, in other implementations it could pivot, rotate or otherwise move into the operative position, or employ additional mechanical stages to effect movement.

The invention claimed is:

1. A barrel cleaner, including a body, the body comprising a manually operable cantilevered lift to raise a barrel, bearings to permit rotation of the barrel once raised, and a spray head support including a spray head, wherein operatively the barrel may be rotated on said bearings once raised by said lift, so that a bung hole of the barrel is in an insertion position, and the spray head support is selectively moveable in use to insert the spray head into the bung hole, wherein the spray head is adapted to be connected to a source of high-pressure water in order to perform a cleaning operation, and an interlock is provided to prevent a cleaning operation of the spray head until the spray head support has been moved into a predetermined operative position.

2. A barrel cleaner according to claim 1, wherein the spray head support comprises a frame slidably mounted on the body.

3. A barrel cleaner according to claim 2, wherein the interlock is a mechanical latch preventing cleaning operation until the latch is released and the frame is slid into the operative position.

4. A barrel cleaner according to claim 2, wherein a lug associated with the spray head engages a valve or switch when the frame is slid into the operative position.

5. A barrel cleaner according to claim 1, wherein the body includes rollers mounted to permit rotation of the barrel once it has been lifted.

6. A barrel cleaner according to claim 5, wherein the body includes a pair of supports, the rollers are mounted on the supports, and the rollers have a tapered diameter, so that operatively, rotation of a barrel on the rollers tends to center the barrel relative to the rollers.

7. A barrel cleaner according to claim 1, wherein the barrel is operatively manually rotatable.

8. A barrel cleaner according to claim 1, wherein the spray head support is substantially protected by the body in an inoperative position.

* * * * *